US008292536B2

(12) United States Patent
Lange et al.

(10) Patent No.: US 8,292,536 B2
(45) Date of Patent: Oct. 23, 2012

(54) METHOD AND APPARATUS OF APPLYING A FLOOR PRODUCT SOLUTION

(75) Inventors: Steven James Lange, St. Paul, MN (US); Minyu Li, Oakdale, MN (US); Eric Richard Balz, Stillwater, MN (US); Brian Philip Carlson, Saint Paul, MN (US)

(73) Assignee: Ecolab USA Inc., St. Paul, MN (US)

( * ) Notice: Subject to any disclaimer, the term of this patent is extended or adjusted under 35 U.S.C. 154(b) by 1223 days.

(21) Appl. No.: 11/717,865

(22) Filed: Mar. 14, 2007

(65) Prior Publication Data

US 2007/0231056 A1 Oct. 4, 2007

(51) Int. Cl.
*A47L 11/04* (2006.01)

(52) U.S. Cl. ..... 401/291; 401/138

(58) Field of Classification Search ..... 401/137–139, 401/282, 291; 15/245.1; 209/417–419
See application file for complete search history.

(56) References Cited

U.S. PATENT DOCUMENTS

| | | | | | |
|---|---|---|---|---|---|
| 456,459 | A | * | 7/1891 | Wright et al. | 209/419 |
| 1,165,259 | A | * | 12/1915 | Houser | 401/290 |
| 1,375,560 | A | | 4/1921 | Campbell | |
| 2,480,023 | A | * | 8/1949 | Holden | 401/28 |
| 2,548,729 | A | * | 4/1951 | Kumpman | 401/195 |
| 2,822,560 | A | | 2/1958 | Pape | |
| 2,866,214 | A | * | 12/1958 | Phillips | 401/291 |
| 2,960,230 | A | * | 11/1960 | Fracker | 209/419 |
| 3,384,438 | A | | 5/1968 | Sherbondy | |
| 3,661,467 | A | | 5/1972 | Dalton | |
| 3,694,097 | A | | 9/1972 | Fedorek | |
| 3,729,268 | A | | 4/1973 | Failing | |
| 3,981,596 | A | | 9/1976 | Melton | |
| 4,107,813 | A | | 8/1978 | Torres | |
| 4,119,386 | A | | 10/1978 | Cushing | |
| 4,152,084 | A | | 5/1979 | Melton et al. | |
| 5,050,530 | A | | 9/1991 | Studebaker et al. | |
| 5,921,596 | A | * | 7/1999 | Sheriff et al. | 294/1.4 |
| 6,315,482 | B1 | | 11/2001 | Girardot et al. | |
| 6,394,683 | B1 | | 5/2002 | Pao | |
| 6,726,386 | B1 | | 4/2004 | Gruenbacher et al. | |
| 2001/0006588 | A1 | | 7/2001 | Zorzo | |
| 2003/0197027 | A1 | | 10/2003 | Dyer | |
| 2003/0235457 | A1 | | 12/2003 | Smith | |
| 2004/0047670 | A1 | | 3/2004 | Martin | |
| 2004/0234324 | A1 | | 11/2004 | Balz et al. | |
| 2004/0253041 | A1 | | 12/2004 | Hall et al. | |
| 2005/0025561 | A1 | | 2/2005 | Larsen | |
| 2005/0063765 | A1 | | 3/2005 | Chase et al. | |
| 2005/0241095 | A1 | | 11/2005 | Olson | |
| 2006/0245820 | A1 | | 11/2006 | Kresse et al. | |

FOREIGN PATENT DOCUMENTS

| | | |
|---|---|---|
| EP | 0 942 678 | 6/1998 |

(Continued)

OTHER PUBLICATIONS

PCT International Preliminary Report on Patentability mailed Sep. 16, 2008.

*Primary Examiner* — David Walczak
(74) *Attorney, Agent, or Firm* — Andrew D. Sorensen; Amy J. Hoffman

(57) ABSTRACT

An applicator tool for applying a liquid onto a surface of a floor includes an applicator and a handle connected to the applicator. The applicator includes a housing having a bottom surface and a plurality of sidewalls. The bottom surface is connected to the sidewalls to define a reservoir. The bottom surface has at least one opening in fluid for substantially continuously dispensing the liquid.

21 Claims, 9 Drawing Sheets

FOREIGN PATENT DOCUMENTS

| | | | |
|---|---|---|---|
| EP | 1169962 | | 1/2002 |
| EP | 1 169 962 | A1 | 9/2002 |
| EP | 1 264 569 | A2 | 12/2002 |
| EP | 1 356 757 | A1 | 10/2003 |
| FR | 620089 | | 4/1927 |
| GB | 3768 | | 0/1915 |
| GB | 5164 | | 0/1902 |
| GB | 2 411 578 | A | 9/2005 |
| WO | WO 96/00029 | | 1/1996 |
| WO | WO 2006/090122 | A1 | 8/2006 |

* cited by examiner

METHOD AND APPARATUS OF APPLYING A FLOOR PRODUCT SOLUTION

CROSS-REFERENCE TO RELATED APPLICATION(S)

This application is related to provisional application Ser. No. 60/782,461, filed on Mar. 15, 2006, and entitled "Method and Apparatus for Applying a Floor Product Solution", which is herein incorporated by reference.

BACKGROUND OF THE INVENTION

The present invention relates generally to a method and apparatus for applying a liquid product to a floor. In particular, the invention relates to applying a thickened liquid floor product to a floor.

A variety of liquid products are applied onto the surface of a floor to provide proper care. One such product is a stripper that removes floor finish already applied on the floor. Such strippers typically have a low viscosity, e.g. 200 cps or less. Traditional floor strippers are applied and distributed on the floor surface with a conventional string mop and bucket. While effective, the use of mops in the stripping process has several undesirable outcomes, including placing stripper on surfaces perpendicular to the floor, such as walls and baseboards, and extensive clean-up time required to rinse residual stripper solution from the mop.

Additional issues associated with applying stripper onto a floor using a conventional mop occur when applying thickened strippers. Thickened strippers typically have a viscosity between approximately 300 and approximately 1,000 cps and provide advantages over lower viscosity strippers. Because such thickened stripper products do not readily flow, they are not as easily applied using a string mop. For instance, mop lines are easily visible on the floor and the areas where the stripper is more thinly applied do not strip as effectively. Additionally, because thickened strippers are typically more viscous, it is difficult to get the thickened stripper into tight spaces such as corners and edges using a conventional mop, without getting the thickened stripper on vertical surfaces such as baseboards and walls. Applying thickened strippers with a string mop is also an ergonomic challenge. If a string mop is utilized, the mop becomes quite heavy and can weigh up to 20 pounds when wet. Further, there is a significant amount of "mop drag" and the mop is only able to dispense approximately three pounds of the thickened stripper before it is necessary to dip the string mop back into the bucket to obtain more thickened stripper.

There is thus a need in the art for an applicator that overcomes the extensive clean-up time, undesirable placement of stripper, ergonomic issues, and leveling problems associated with string mop applications.

BRIEF SUMMARY

In a first embodiment, an applicator tool for applying a liquid onto a surface of a floor includes an applicator and a handle connected to the applicator. The applicator includes a housing having a bottom surface and a plurality of sidewalls. The bottom surface is connected to the sidewalls to define a reservoir. The bottom surface has at least one opening in fluid for substantially continuously dispensing the liquid.

In another embodiment, a method of dispensing a liquid product onto a surface includes filling a reservoir of an applicator with liquid product, moving the applicator across the surface, and continuously dispensing the liquid product from the applicator. The applicator has an open top surface, a bottom surface, and at least one opening formed in the bottom surface. The liquid product is dispensed through the opening in the bottom surface of the applicator.

In another embodiment, the invention is an applicator tool for applying a liquid product onto a floor. The applicator tool includes an applicator, a handle connectable to the applicator, and a spreading mechanism. The applicator has a substantially planar bottom surface that includes at least one opening for continuously dispensing the liquid product. The spreading mechanism is formed of a flexible material connected to the bottom surface of the applicator and spaces the bottom surface of the applicator from the floor.

DETAILED DESCRIPTION

Figure 1:
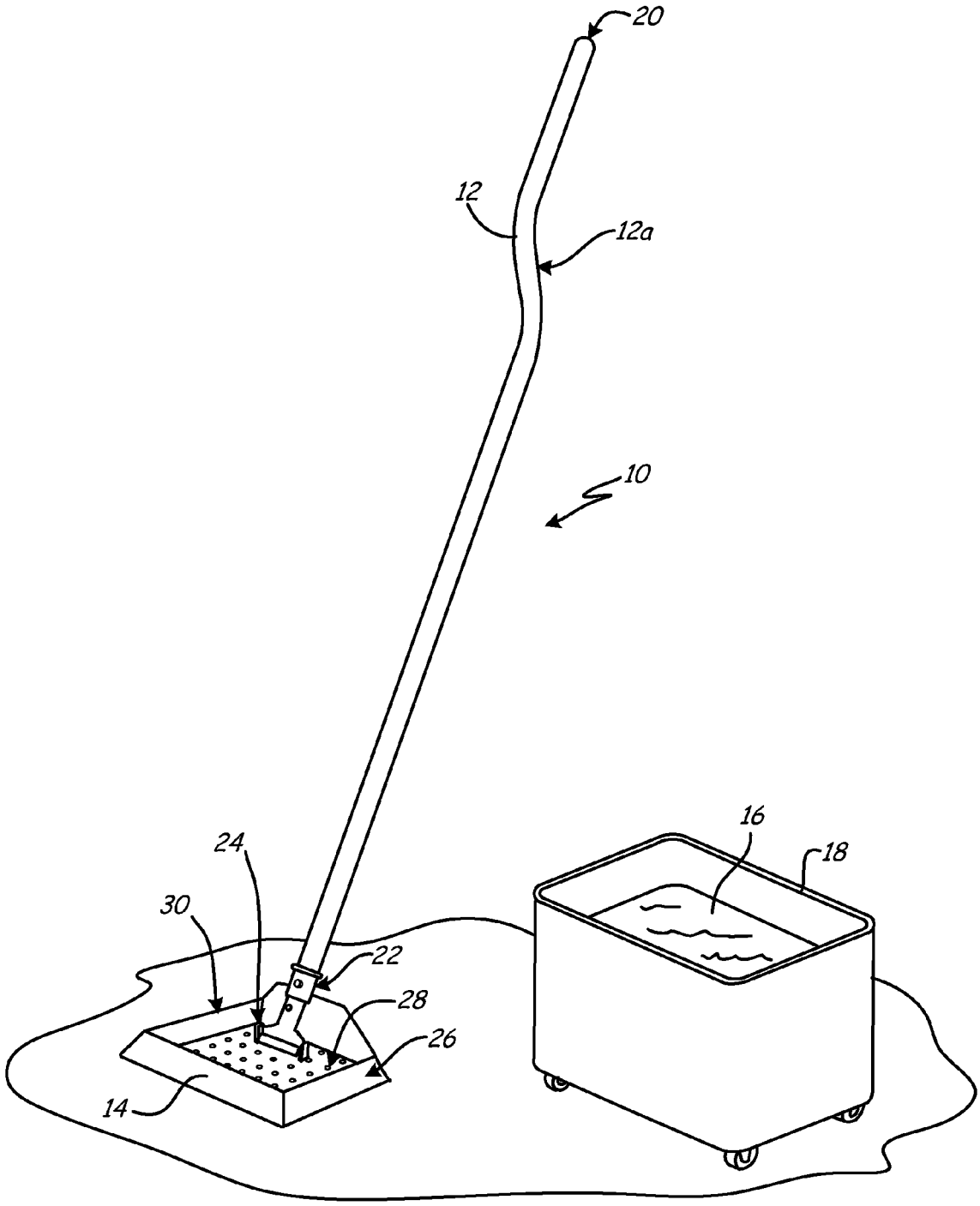
FIG. 1 is a perspective view of an applicator tool.

FIG. 1 shows a perspective view of applicator tool 10 generally including handle 12 and applicator 14 pivotally connected to handle 12. Tool 10 provides a light-weight and ergonomically efficient tool for applying liquid product 16 onto a floor. Liquid product 16 may be any suitable liquid floor care product including, but not limited to: a low viscosity stripper or a thickened stripper. As can be seen in FIG. 1, applicator 14 of tool 10 is sized to fit into a standard bucket 18, alleviating the clean-up time required from excessive splashing of liquid product 16 when depositing applicator 14 into, and removing applicator 14 from, bucket 18. In addition, the leveling issues raised by string mops are also eliminated by tool 10.

Handle 12 has first end 20 for gripping and second end 22 pivotally connected to applicator 14 at pivot joint 24. Handle 12 may have a bend 12*a* between first and second ends 20 and 22 to allow a more ergonomically correct grip of tool 10. Handle 12 may be separate or an integral portion of tool 10 and may be formed by any means known in the art. In an exemplary embodiment, handle 12 has approximately 360 degrees of movement for easier application of liquid product 16.

Applicator 14 generally includes housing 26 that forms reservoir 28 having an open top 30. In operation, when applicator tool 10 is to be used, tool 10 is lifted at first end 20 of handle 12 to submerge applicator 14 into bucket 18. When applicator 14 is submerged within bucket 18, liquid product 16 housed in bucket 18 is allowed to enter reservoir 28 of applicator 14 through open top 30. Housing 26 may be formed of materials including, but not limited to: a polymer or stainless steel. In an exemplary embodiment, housing 26 is approximately 12 inches by approximately 8.5 inches by approximately 2.5 inches. However, applicator 14 may vary in size as long as it is adapted and configured to fit into the standard size mop bucket 18.

Figure 2:
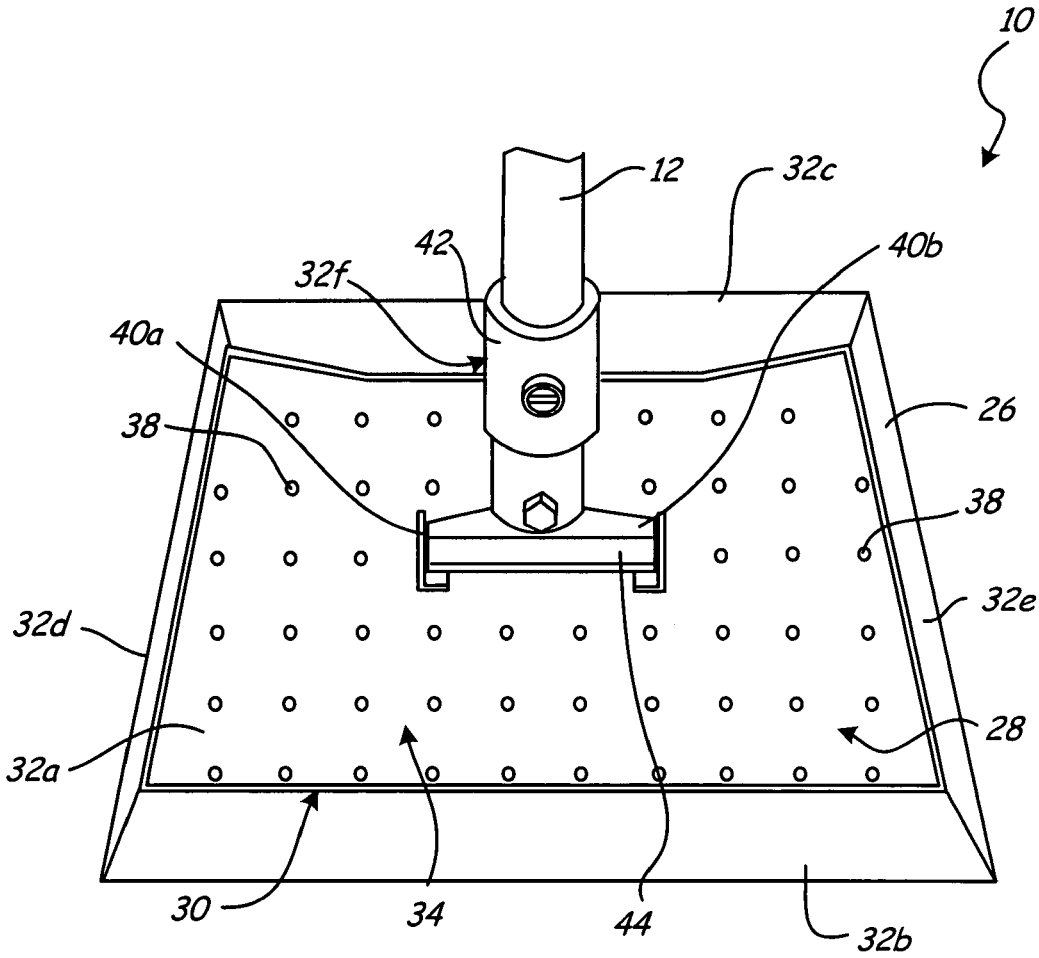
FIG. 2 is a partial top perspective view of a first embodiment of an applicator of the applicator tool.

FIG. 2 shows an enlarged perspective view of a first embodiment of housing 26 of applicator 14. Housing 26 generally includes bottom wall 32*a* connected to front wall 32*b*, rear wall 32*c*, first side wall 32*d*, and second side wall 32*e*. Bottom wall 32*a* and walls 32*b*-32*e* form reservoir 28. Front wall 32*b* is slightly wider than rear wall 32*c*. Walls 32*b*-32*e* are generally angled or curved upward and inward from bottom wall 32*a* to form open top 30, which provides access into reservoir 28. Walls 32*b*-32*e* are angled inward to help minimize sloshing and splashing of liquid product 16 during application. In an exemplary embodiment, walls 32*b*-32*e* are approximately 2 inches in height and are angled approximately 30 degrees inward. These dimensions allow applicator 14 to hold approximately 1000 milliliters of liquid product 16. Rear wall 32*c* also includes notch 32*f* sized to engage handle 12. Although FIG. 2 depicts housing 26 as generally rectangular in shape, housing 26 may take on any shape without departing from the scope of the present invention.

Bottom wall 32*a* of housing 26 includes top surface 34, bottom surface 36 (shown in FIG. 3), plurality of holes 38, first mounting member 40*a*, and second mounting member 40*b*. Top surface 34 of bottom wall 32*a* provides a base for reservoir 28 and faces away from the floor. Holes 38 are generally equally spaced from one another and extend through bottom wall 32*a* such that reservoir 28 is in communication with the floor. Liquid product 16 stored in reservoir 28 exits from reservoir 28 by gravity through holes 38. There may be more holes 38 toward front wall 32*b* of applicator 14, where applicator 14 is slightly wider, than at rear wall 32*c*. In an exemplary embodiment, holes 38 are approximately 0.25 inches in diameter and are spaced approximately 1 inch from one another. The size and number of holes 38 may vary depending upon the viscosity of liquid product 16 in reservoir 28 and the rate at which it is desired to dispense liquid product 16. Also, although FIG. 2 depicts holes 38 as being circular in shape, holes 38 may take any shape without departing from the intended scope of the present invention. For example, holes 38 may be slots or other sized openings. In an exemplary embodiment, bottom wall 32*a* has between approximately thirty-six and approximately forty-eight holes 38 for dispensing liquid product 16.

First and second mounting members 40*a* and 40*b* are attached to top surface 34 of bottom wall 32*a* and function as a fastening mechanism to attach second end 22 of handle 12 to applicator 14. First and second mounting members 40*a* and 40*b* are positioned substantially equidistant from each of walls 32*b*-32*e* to ensure the widest range of motion for handle 12. To attach handle 12 to first and second mounting members 40*a* and 40*b*, second end 22 of handle 12 engages sleeve 42, which is attached to connector 44. Connector 44 is pivotally attached to first and second mounting members 40*a* and 40*b* such that handle 12 can move toward front wall 32*b* and rear wall 32*c*. In addition, handle 12 is rotatably secured within sleeve 42, allowing handle 12 to pivot towards first side wall 32*d* and second side wall 32*e* and rotate with respect to housing 26. This connection allows for approximately 360 degrees of movement, although it is understood that other suitable connections may also be utilized. As previously mentioned, rear wall 32*c* includes notch 32*f* sized and positioned such that when tool 10 is lifted, handle 12 settles in notch 32*f* in rear wall 32*c*. First and second mounting members 40*a* and 40*b* are offset such that when tool 10 is lifted straight upward, tool 10 tilts so that handle 12 rests in notch 32*f* of rear wall 32*c*. This feature is important as it "locks" handle 12 in place and prevents liquid product 16 from spilling over walls 32*b*-32*e* of tool 10.

Liquid product 16 (shown in FIG. 1) is held within reservoir 28 of housing 26. The size of reservoir 28 may vary depending upon the desired amount of liquid product 16 that is to be held in reservoir 28. In an exemplary embodiment, reservoir 28 holds between approximately 1 liter and approximately 4 liters of liquid product 16, and preferably between approximately 1.5 liters and approximately 2.5 liters of liquid product 16. One fill of reservoir 28 covers approximately as much area of floor as approximately one saturation of a string mop. However, the weight of a string mop saturated with approximately 1.5 liters of liquid product 16 is approximately 20 pounds, while tool 10 has a weight of only approximately 5.5 pounds. Tool 10 is thus more easily manipulated by an operator than a string mop. Holes 38 through bottom wall 32*a* are sized and positioned such that liquid product 16 is dispensed from reservoir 28 at a flow rate equal to or greater than the rate at which an experienced user will spread liquid product 16 on a floor. In an exemplary embodiment, liquid product 16 has a viscosity of between approximately 1 centipoise (cps) and approximately 1,000 cps, preferably between approximately 300 and approximately 1,000 cps, and most preferably approximately 600 cps. In an exemplary embodiment, the flow rate of liquid product 16 from reservoir 28 through holes 38 of bottom wall 32*a* is approximately 1 gallon per minute.

Figure 3:
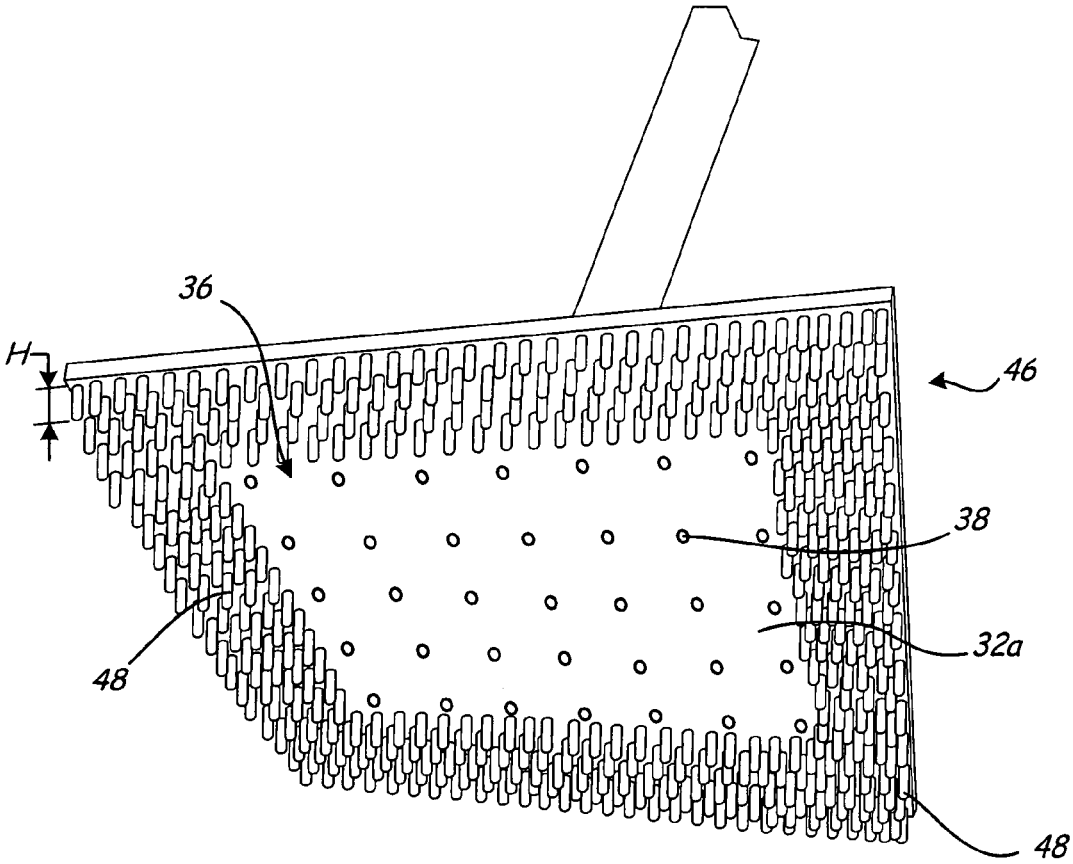
FIG. 3 is a bottom perspective view of a first embodiment of a spreading mechanism of the applicator.

FIG. 3 shows a bottom perspective view of bottom surface 36 of bottom wall 32*a*. A first embodiment of a spreading mechanism 46 is attached to bottom surface 36 of bottom wall 32*a*. Spreading mechanism 46 includes a plurality of flexible projections 48 around the perimeter of bottom surface 36 of bottom wall 32*a*. Flexible projections 48 aid in spreading a smooth layer of liquid product 16 from reservoir 28 (shown in FIG. 2) on the floor and are arranged along the perimeter of bottom surface 36 such that liquid product 16 may be spread without leaving any gaps. In an exemplary embodiment, projections 48 extend from the perimeter of bottom wall 32*a* between approximately 0.375 inches and approximately 2 inches toward the center of bottom wall 32*a*. Preferably, projections 48 extend from the perimeter of bottom wall 32*a* between approximately 0.375 inches to approximately 0.5 inches toward the center of bottom wall 32*a*. Flexible projections 48 are arranged in multiple rows that are offset from one another to ensure complete coverage when spreading liquid product 16 onto the floor. In an exemplary embodiment, flexible projections 48 are between approximately 0.5 inches and approximately 1 inch long and have a diameter of approximately 0.1. In another exemplary embodiment, flexible projections 48 are arranged in offset rows to have a density of approximately 64 projections per square inch. Flexible projections 48 may be formed of any substantially non-porous material that is flexible and chemically inert, including, but not limited to: polypropylene, butyl rubbers, and microfibers. The material forming flexible projections 48 may optionally include surface treatments. An example of a commercially available non-porous material includes, but is not limited to, Nomad, available from 3M Corporation, Saint Paul, Minn. Although FIG. 3 depicts projections 48 as covering only the perimeter of bottom surface 36, projections 48 may cover substantially the entire bottom surface 36 without departing from the intended scope of the present invention.

In operation, protrusions 48 contact the floor such that bottom wall 32*a* of housing 26 is spaced from the floor by protrusions 48. Projections 48 are raised a height H from the floor. Height H determines the thickness that liquid product 16 is applied to the floor as applicator 14 is moved back and forth along the floor. However, height H may vary depending upon the actual stripper, the type of liquid product being used, or roughness of the surface being treated. Height H may also be varied by changing the thickness, height, or flexibility of projections 48.

Figure 4:
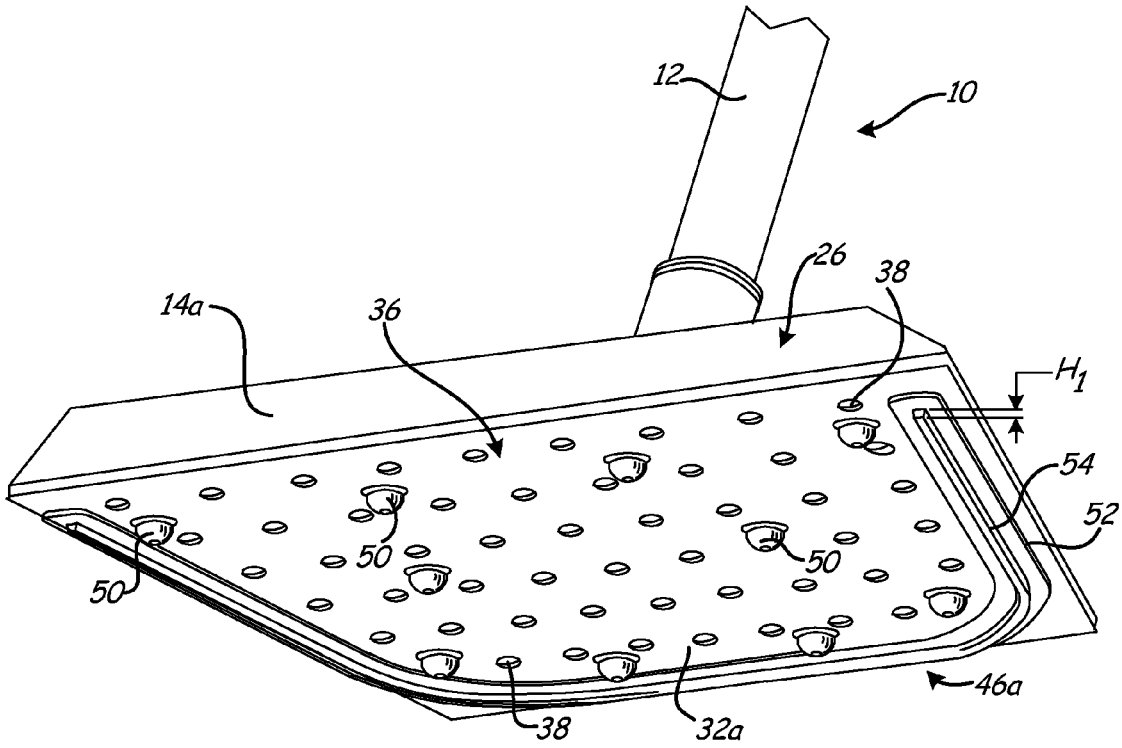
FIG. 4 is a bottom perspective view of a second embodiment of the spreading mechanism of the applicator.

FIG. 4 shows a bottom perspective view of bottom surface 36 with a second embodiment of spreading mechanism 46*a*. Spreading element 46*a* generally includes a plurality of protrusions 50 connected to bottom surface 36 of bottom wall 32*a*. Protrusions 50 provide a surface on which applicator 14*a* is moved about on the floor and may be made from a suitable material including, but not limited to: a hard plastic, stainless steel, a roller ball, or a wheel. A U-shaped spreader element 52 is positioned around a portion of the perimeter of bottom surface 36. Extending downward from U-shaped spreader element 52 is elongate raised member 54, which has a height greater than U-shaped spreader element 52. In an exemplary embodiment, spreader element 52 and elongated raised member 54 are flexible, allowing them to follow the contour of the floor as tool 10 is utilized. Elongate raised member 54 may be made of any suitable material including, but not limited to: rubber, high density polyethylene (HDPE), vinyl, silicone, polypropylene, and microfiber textile.

In operation, protrusions 50 contact the floor such that bottom wall 32*a* of housing 26 is spaced from the floor by protrusions 50. The next surface up vertically from the floor is elongate raised member 54. Elongate raised member 54 is raised a height $H_1$ from the floor. Height $H_1$ determines the thickness that liquid product 16 is applied to the floor as applicator 14 is moved back and forth along the floor. In an exemplary embodiment, height $H_1$ is between approximately ⅛ inches and approximately ¼ inches for a thickened stripper having a viscosity of between approximately 300 cps and approximately 1,000 cps. However, height $H_1$ may vary depending upon the actual stripper, the type of liquid product being used, or roughness of the surface being treated.

Figure 5:
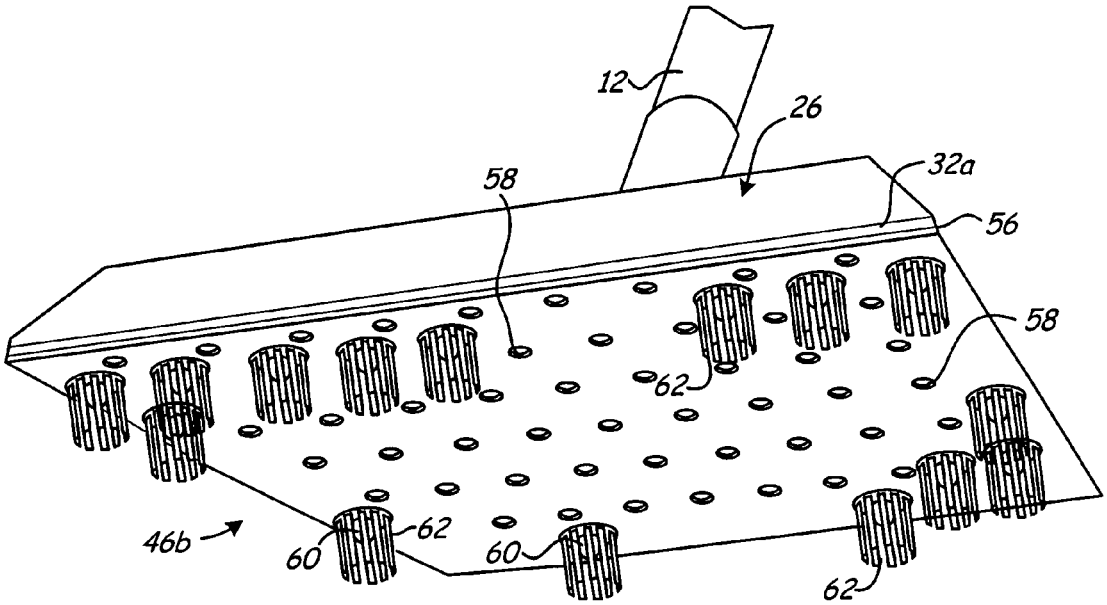
FIG. 5 is a bottom perspective view of a third embodiment of the spreading mechanism of the applicator.
Figure 5A:
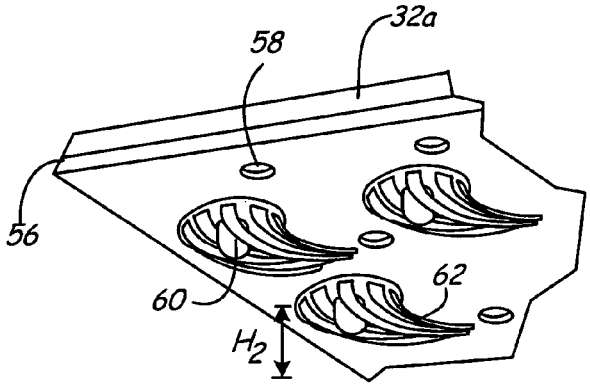
FIG. 5A is a partial perspective view of the third embodiment of the spreading mechanism of the applicator.

FIG. 5 shows a bottom perspective view of housing 26 with a third embodiment of spreading mechanism 46*b* and FIG. 5A shows a perspective view of a portion of the third embodiment of spreading mechanism 46*b*. FIGS. 5 and 5A will be discussed in conjunction with one another. Spreading mechanism 46*b* covers substantially all of bottom surface 36 of bottom wall 32*a* (shown in FIG. 2) and generally includes base 56, openings 58, central protrusions 60, and finger-like projections 62. Base 56 is secured to bottom surface 36 of bottom wall 32*a* by any suitable means known in the art, including, but not limited to: an adhesive or Velcro™. Openings 58 in base 56 are aligned with holes 38 (shown in FIG. 2) of bottom wall 32*a* of applicator 14 for dispensing liquid product 16. Central protrusions 60 are connected to base 56 and are encircled by longer, finger-like projections 62. Central protrusions 60 have a diameter greater than a diameter of finger-like projections 62 and are not as flexible as finger-like projections 62. It should be understood that although FIG. 5 only depicts a few projections 60 and 62, central protrusions 60 and finger-like projections 62 extend the width and length of base 56. Finger-like projections 62 easily bend, as shown in FIG. 5A, when force is applied. When tool 10 is in use, finger-like projections 62 bend with applicator 14 being held at a height from the floor substantially by central protrusions 60, but also slightly by finger-like projections 62. When in use, the thickness of liquid product 16 being dispensed on the floor will be determined by the distance, or height $H_2$, from base 56 to the support provided by central protrusions 60 and finger-like projections 62. Height $H_2$ may be varied by changing the thickness, height, or flexibility of central protrusions 60 as well as the thickness, length, or flexibility of finger-like projections 62. Although FIGS. 5 and 5A depict each central protrusion 60 as being surrounded by eight finger-like projections 62, any number of finger-like projections 62 may surround each central protrusion 60 without departing from the intended scope of the present invention.

Figure 6:
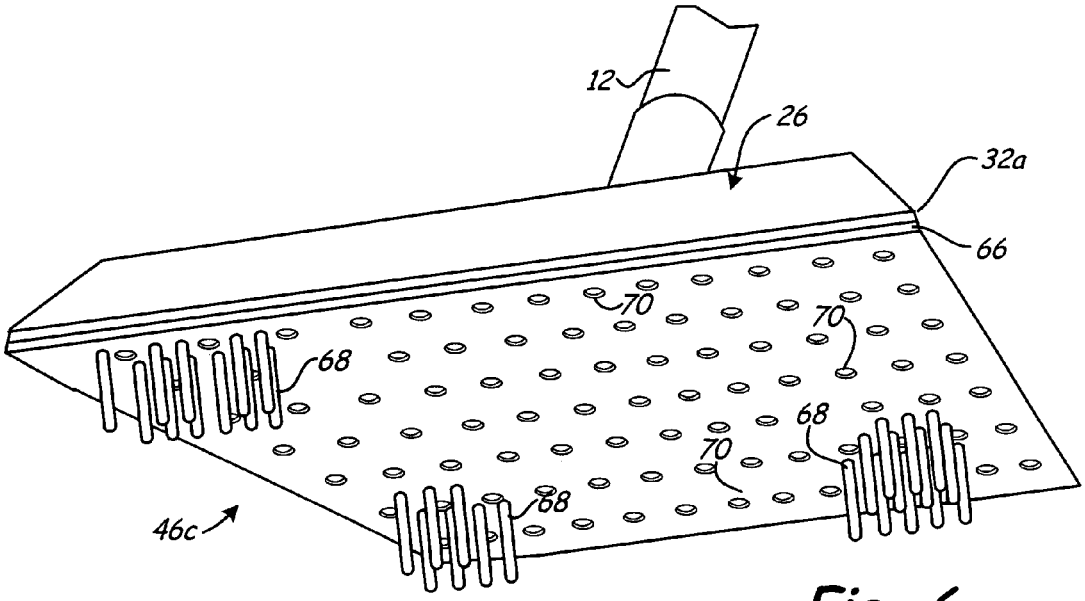
FIG. 6 is a bottom perspective view a fourth embodiment of the spreading mechanism of the applicator.
Figure 6A:
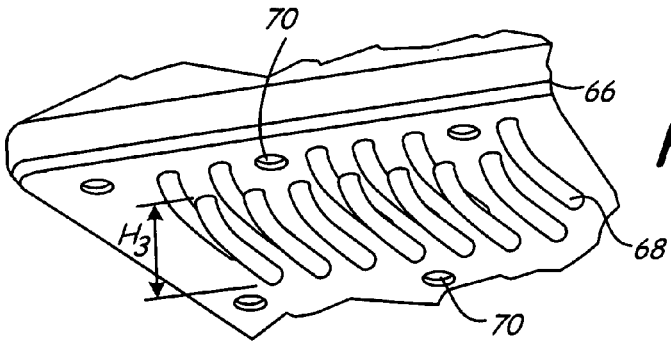
FIG. 6A is a partial perspective view of the fourth embodiment of the spreading mechanism of the applicator.

FIG. 6 shows a bottom perspective view of housing 26 with a fourth embodiment of spreading mechanism 46*c* and FIG. 6A shows a perspective view of a portion of spreading mechanism 46*c*. FIGS. 6 and 6A will be discussed in conjunction with one another. Spreading element 46*c* includes base 66, projections 68, and openings 70. Base 66 is secured to bottom surface 36 (shown in FIG. 2) of bottom wall 32*a* by any suitable means, including, but not limited to: an adhesive or Velcro™. For simplicity, FIG. 6 depicts only a few projections 68 and openings 70, however, in practice, projections 68 and openings 70 span the width and length of base 66. Projections 68 are connected to base 66 and easily bend, as shown in FIG. 6A, when force is applied. While projections 68 are approximately the same diameter as central projections 60 of the third embodiment of spreading mechanism 46*b*, they are longer than central projections 60 (shown in FIGS. 5 and 5A). Base 66 also has openings 70, which are aligned with holes 38 (shown in FIG. 2) of bottom wall 32*a* to allow liquid product 16 to flow from reservoir 28.

In operation, projections 68 bend and maintain bottom wall 32*a* of applicator 14 from the floor as applicator 14 is moved along the floor. The thickness of liquid product 16 being dispensed onto the floor is determined by the distance, or height $H_3$, from base 66 to the support provided by projections 68. Height $H_3$ may be varied by changing the thickness, height, or flexibility of projections 68.

Referring back to FIGS. 1 and 2, tool 10, whether utilizing the first, second, third, or fourth embodiment of spreading mechanism 46, 46*a*, 46*b*, or 46*c*, operates substantially the same, except for minor variances. In operation, bucket 18 is first filled with liquid product 16 to be dispensed, such as a suitable floor stripper. Tool 10 is then grasped by handle 12 and applicator 14 is submerged below the level of the liquid product 16 in bucket 18 such that liquid product 16 flows into reservoir 28. When reservoir 28 is filled, applicator 14 is lifted and removed from bucket 18. As reservoir 28 is removed from bucket 18, handle 12 rests in notch 32*f* of rear wall 32*c* and prevents reservoir 28 from tipping and spilling liquid product 16. Liquid product 16 exits reservoir 28 through holes 38 in bottom surface 36 as applicator 14 with spreading mechanism 46, 46*a*, 46*b*, or 46*c* is moved across the floor by movement of handle 12. Handle 12 may be rotated along an axis that provides rotational movement forward, backward, or sideways. Further, the angle or curvature of sidewalls 32*b*-32*e* help prevent liquid product 16 from spilling from reservoir 28.

Each spreading mechanism 46, 46*a*, 46*b*, or 46*c* provides a more even distribution of liquid product 16, especially a thickened floor stripper, onto the floor. In all embodiments of spreading mechanism 46, 46*a*, 46*b*, and 46*c*, liquid product 16 is dispensed through holes 38. The spreading and leveling action is slightly different with respect to each spreading mechanism 46, 46*a*, 46*b*, or 46*c*. When the first embodiment of spreading mechanism 46 is used, applicator 14 is held off of the floor by protrusions 46 and the thickness of liquid product 16 being applied is controlled by the difference in height H between protrusions 46 and the floor. With respect to the second embodiment of the spreading mechanism 46*a*, when applicator 14 is placed on the floor, applicator 14 is held off of the floor by protrusions 50 and the thickness of liquid product 16 being applied is controlled by the difference in height $H_1$ between protrusions 50 and elongate raised member 54. With respect to the third embodiment of spreading mechanism 46*b*, when applicator 14 is placed on the floor, projections 60 and 62 bend and the thickness of liquid product 16 being dispensed will be controlled by the difference in height $H_2$ between projections 60 and 62 and the floor. With respect to the fourth embodiment of spreading mechanism 46*c*, when applicator 14 is placed on the floor, projections 68 bend over, as shown in FIG. 6A, and the thickness of liquid product 16 being dispensed will be controlled by the difference in height $H_3$ between projections 68 and the floor.

Spreading mechanisms 46, 46*a*, 46*b*, or 46*c* are textile free and utilize spreaders that are also textile free, although a textile such as a microfiber may also be used. Projections 48 of the first embodiment of spreading mechanism 46; projections 50 and elongate raised member 54 of the second embodiment of spreading mechanism 46*a*; base 56 and central protrusions 60 and finger-like projections 62 of the third embodiment of spreading mechanism 46*b*; and base 66 and projections 68 of the fourth embodiment of spreading mechanism 46*c* are all textile free (or a microfiber) and substantially non-absorbent. They are typically made from a suitable polymer as previously discussed. Elongate raised member 54, projections/protrusions 48, 50, 60, 62, and 68 are relatively soft, lightweight, and easy to clean.

Spreading mechanism 46, 46*a*, 46*b*, or 46*c* may also be used without a reservoir 28. In such instances, liquid product 16 may be placed on the floor. In such instances, liquid product 16 may be placed on the floor by any means known in the art, including, but not limited to: pouring liquid product 16 from a bottle or throwing liquid product 16 from bucket 18. Alternatively, there may not be any holes or openings at the bottom of reservoir 28. In such instances, reservoir 28 may be emptied by tipping applicator 14 to dispense liquid product 16 out of open top 30 of reservoir 28. It is also understood that instead of filling reservoir 28 by immersing it in bucket 18, reservoir 28 may be filled by other methods, such as by pouring liquid product 16 from a bottle or container into reservoir 28 through an appropriate opening. Also, reservoir 28 may be a snap-on with the snap-on being brought to a location where it is filled and then brought back and placed on handle 12.

Figure 7:
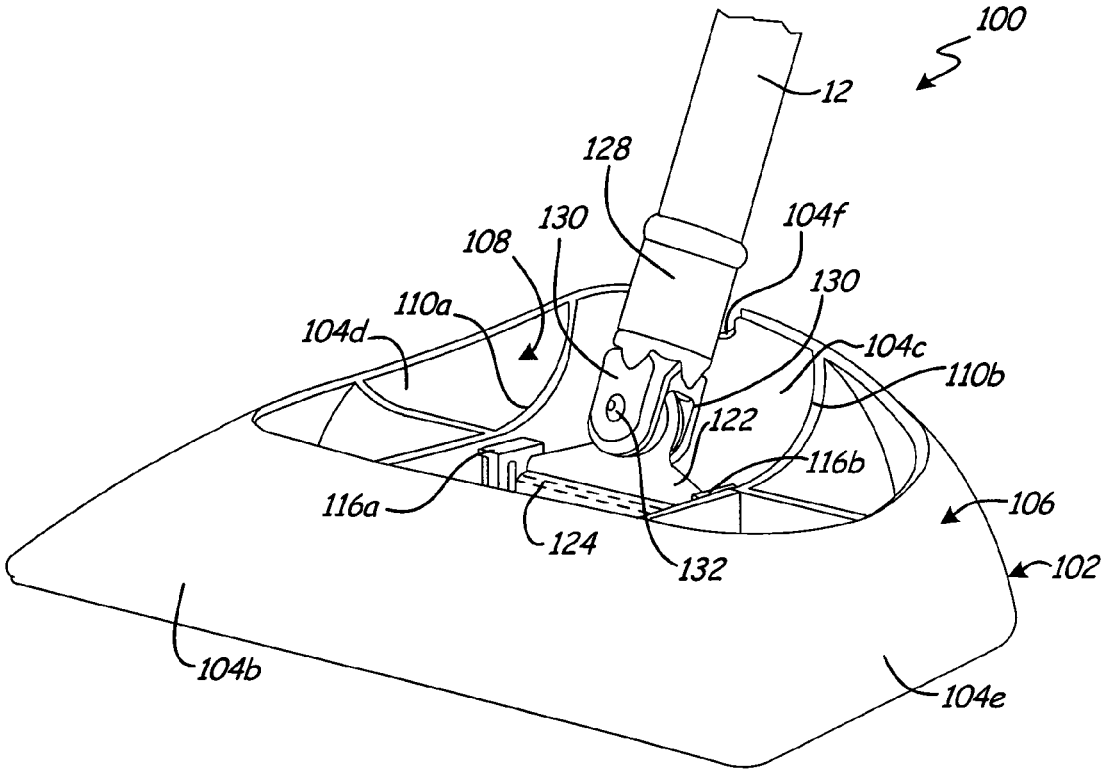
FIG. 7 is a partial top perspective view of a second embodiment of an applicator of the applicator tool.
Figure 8:
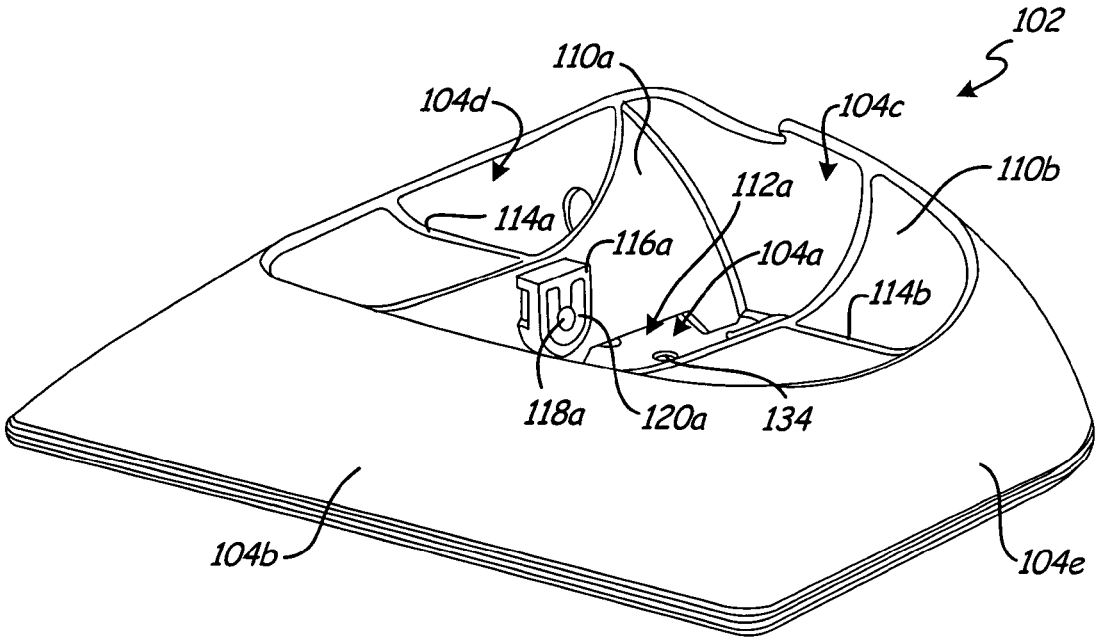
FIG. 8 is an enlarged top view of the second embodiment of the applicator of the applicator tool.
Figure 9:
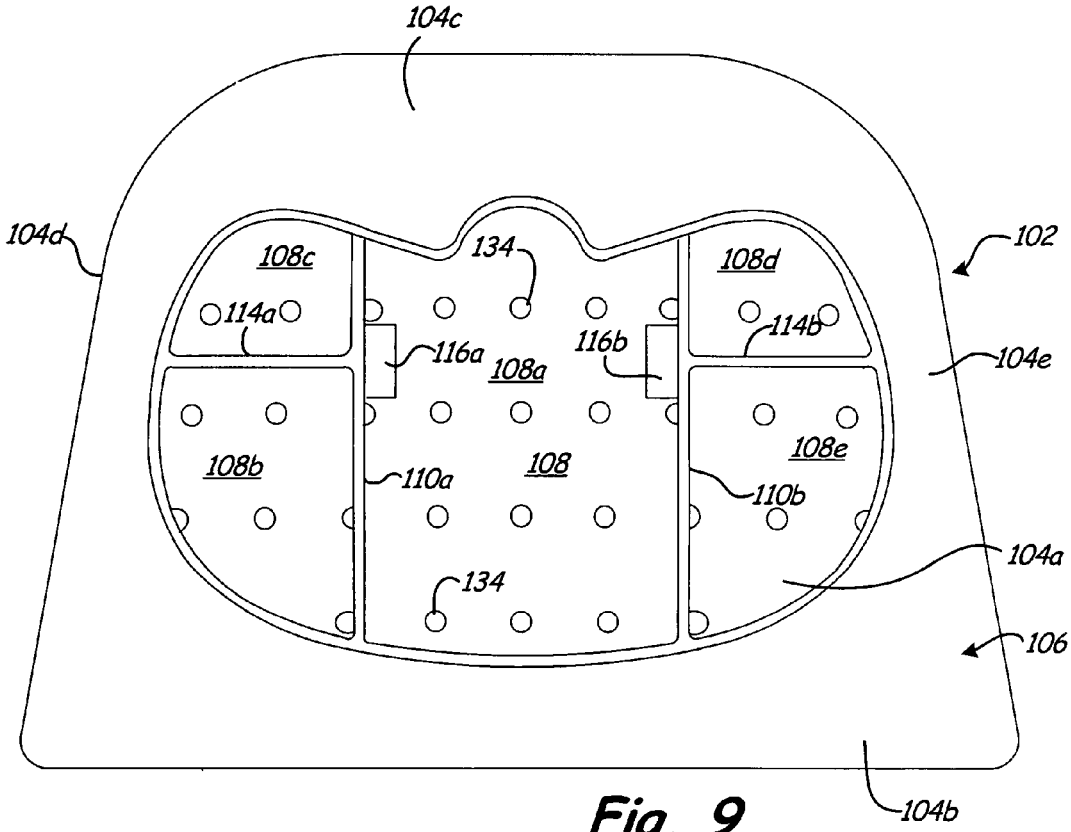
FIG. 9 is an enlarged top plan view of the second embodiment of the applicator of the applicator tool.

FIGS. 7, 8, and 9 show a top perspective view, an enlarged top view, and a top plan view of a second embodiment of tool 100 having a second embodiment of applicator 102, respectively, and will be discussed in conjunction with one another. The second embodiment of applicator 102 is similar to the first embodiment of applicator 14 shown in FIGS. 1 and 2. Applicator 102 generally includes bottom wall 104*a* (shown in FIGS. 8 and 9), front wall 104*b*, rear wall 104*c*, first side wall 104*d*, and second side wall 104*e*. Walls 104*a*-104*e* form housing 106 and reservoir 108. A first dividing member 110*a* and a second dividing member 110*b* extend from rear wall 104*c* to front wall 104*b*. As shown in FIG. 8, only a portion of first dividing member 110*a* extends down to bottom surface 104*a*. An opening 112*a* spaces a portion of first dividing member 110*a* from bottom wall 104*a*. Second dividing member 110*b* has a similar opening (not shown). A first cross member 114*a* extends between first dividing member 110*a* and first side wall 104*d* and a second cross member 114*b* extends between second dividing member 110*b* and second side wall 104*e*. Dividing members 110*a* and 110*b* and respective cross members 114*a* and 114*b* divide reservoir 108 into first compartment 108*a*, second compartment 108*b*, third compartment 108*c*, fourth compartment 108*d*, and fifth compartment 108*e*. Opening 112*a* allows fluid communication between first compartment 108*a*, second compartment 108*b*, and third compartment 108*c*. A second opening 112*b* (not shown), similar to opening 112*a* in second dividing member 110*b* allows fluid communication between first compartment 108*a*, fourth compartment 108*d*, and fifth compartment 108*e*.

A first mounting member 116*a* is connected to first dividing member 110*a* and a second mounting member 116*b* is connected to second dividing member 110*b*. Mounting members 116*a* and 116*b* are mirror images of each other. For simplicity, only first mounting member 116*a* will be described in more detail, although it should be understood that second mounting member 116*b* has the same features as first mounting member 116*a*. Although first mounting member 116*a* has the same features as first mounting member 116*a*. Although first mounting member 116*a* is depicted as being a two-piece injected molded part, any suitable construction may be utilized. First mounting member 116 generally includes a U-shaped protrusion 118*a* and a bore 120*a*. U-shaped protrusion 118*a* is matched to a U-shaped opening to connect the two injection molded parts of second mounting member 116*b*. Again, the construction may be any suitable construction. A yoke member 122 has a pin 124 (shown in FIG. 7) that protrudes and extends into bore 120*a* of first mounting member 116*a* and corresponding bore 120*b* (not shown) in second mounting member 116*b*. Pin 124 may extend through the length of yoke member 122 or alternately may be two separate protrusions that extend into bores 120*a* and 120*b*. Yoke member 122 is rotationally attached to applicator 102 and allows movement from the front to the back of applicator 102. Collar 128 is positioned at the base of handle 12 and is secured between two flanges 130. Mounting flanges 130 are pinned to yoke member 122 by pins 132. This allows for rotational movement of handle 12 from the right side to the left side of applicator 102. Mounting members 116*a* and 116*b* are offset toward rear wall 104*c* such that when tool 100 is lifted, handle 12 settles in notch 104*f* in rear wall 104*c*.

Bottom wall 104*a* of applicator 102 includes holes 134 that allow reservoir 108 to be in communication with the floor. Similar to the first embodiment of applicator 14, holes 134 are generally equally spaced from one another and extend through bottom wall 104*a*. In an exemplary embodiment, holes 134 are approximately 0.25 inches in diameter and are spaced approximately 1 inch from one another. The size and number of holes 134 may vary depending upon the viscosity of liquid product 16 in reservoir 108 and the rate at which it is desired to dispense liquid product 16. Also, although FIGS. 8 and 9 depict holes 134 as being circular in shape, holes 134 may take any shape without departing from the intended scope of the present invention. For example, holes 134 may be slots or other sized openings. In an exemplary embodiment, bottom wall 104*a* has between approximately thirty-six and approximately forty-eight holes 134 for dispensing liquid product 16.

The second embodiment of applicator 102 may use first, second, third, or fourth embodiments of spreading mechanism 46, 46*a*, 46*b*, or 46*c* (shown and described in FIGS. 3, 4, 5, 5A, 6, and 6A). Spreading mechanisms 46, 46*a*, 46*b*, or 46*c* are attached to bottom wall 104*a* of applicator 102 similarly to how spreading mechanisms 46, 46*a*, 46*b*, or 46*c* are attached to bottom wall 32*a* of applicator 14 and function similarly as well.

The applicator tool generally includes an applicator and a handle rotatably connectable to the applicator. The applicator has a spreading mechanism that is beneficial in more evenly spreading a liquid product on the floor by reducing the surface area of the applicator that is in contact with the floor, thus reducing surface drag during application. The spreading mechanism of the applicator is particularly useful for evenly spreading a thickened liquid product, i.e., having a viscosity of from approximately 300 to approximately 1,000 cps. The spreading mechanism provides an even distribution of the liquid product on the floor. The spreading mechanism may be either permanently or removably attached to a bottom surface of the applicator. Projections space the bottom surface of the applicator from the floor and spreads the liquid product. Because the applicator is textile free, it will not absorb any of the liquid product, allowing the applicator to spread the liquid product across the floor more evenly. The applicator may also be constructed of natural and synthetic polymers or of a textile-based product such as a microfiber.

Although the present invention has been described with reference to preferred embodiments, workers skilled in the art will recognize that changes may be made in form and detail without departing from the spirit and scope of the invention.

The invention claimed is:

1. An applicator tool adapted for applying a liquid onto a surface of a floor, the applicator tool comprising:

(a) a housing having a bottom surface and a plurality of sidewalls, a front wall and a rear wall wherein the sidewalls and front wall and rear wall are connected to the bottom surface to define a reservoir adapted to receive liquid, and wherein the bottom surface has at least one opening for substantially continuously dispensing the liquid;

(b) a handle pivotably connectable to the bottom of the housing, the connection offset toward the rear of the housing such that upon lifting the liquid-filled reservoir, the handle interacts with the rear wall to prevent the reservoir from tipping and spilling the liquid.

2. The applicator tool of claim 1, wherein the bottom surface comprises a plurality of openings.

3. The applicator tool of claim 1, wherein the sidewalls angle generally upward and inward from the bottom surface.

4. The applicator tool of claim 1, wherein the applicator tool is adapted to dispense liquid having a viscosity of between approximately 1 centipoise and approximately 1000 centipoise.

5. The applicator tool of claim 1, and further comprising a spreading mechanism connected to the bottom surface.

6. The applicator tool of claim 5, wherein the spreading mechanism comprises:

(a) a spreading element connected along at least a portion of a perimeter of the bottom surface; and (b) a plurality of protrusions operatively connected to the bottom surface of the housing, wherein the liquid is spread at a thickness substantially equal to a height of the protrusions.

7. The applicator tool of claim 6, wherein the protrusions are flexible.

8. The applicator tool of claim 5, wherein the spreading mechanism is textile free.

9. The applicator tool of claim 5, wherein the spreading mechanism comprises:

(a) a base connected to the bottom surface of the applicator, (b) a plurality of projections connected to the base; and (c) wherein the projections are flexible and configured to bend an amount sufficient to maintain the base a distance from the floor.

10. The applicator tool of claim 9, wherein the base layer has at least one opening aligned with the opening of the bottom surface of the housing.

11. The applicator tool of claim 1, wherein the holds from about 1 to 4 liters of liquid.

12. The applicator of claim 1, wherein the housing is formed of at least one of: steel and a polymer.

13. A method of dispensing a liquid product onto a surface, the method comprising:

(a) filling a reservoir of an applicator with liquid product, wherein the applicator has (i) an open top surface, a bottom surface, a front wall, a rear wall and a plurality of sidewalls extending from the bottom surface to define the reservoir, and at least one opening formed in the bottom surface; and (ii) a handle pivotably connectable to the bottom of the reservoir and the connection offset toward the rear of the housing such that upon lifting the liquid-filled reservoir, the handle interacts with the rear wall to prevent the reservoir from tipping and spilling the liquid;

(b) moving the applicator across the surface; and (c) continuously dispensing the liquid product form the applicator through the opening in the bottom surface of the applicator.

14. The method of claim 13, further comprising using a spreading mechanism, to apply a coating of the liquid product onto the surface.

15. An applicator tool adapted for applying a liquid product onto a floor, the applicator tool comprising:

(a) an applicator having a reservoir with a substantially planar bottom surface, wherein the reservoir is suitable for containing a liquid and the bottom surface comprises at least one opening for continuously dispensing the liquid product and further wherein the bottom surface is comprised of a liquid receiving surface and a liquid dispensing surface, the liquid receiving surface opposite the liquid dispensing surface;

(b) a handle pivotably connectable to the liquid receiving bottom surface of the applicator and the connection being offset toward the rear of the applicator such that upon lifting the applicator, the handle interacts with the rear of the applicator to prevent the dispenser from tipping and spilling the liquid; and (c) a spreading mechanism formed of flexible material connected to the liquid dispensing bottom surface of the applicator, wherein the spreading mechanism spaces the bottom surface of the applicator from the floor.

16. The applicator tool of claim 15, wherein the applicator further comprises a front wall, a rear wall, a first sidewall, and a second sidewall, wherein the walls are connected to the bottom surface, and wherein the walls and the bottom surface define a reservoir.

17. The applicator tool of claim 16, wherein the sidewalls angle substantially upward and inward from the bottom surface.

18. The applicator tool of claim 16, wherein the rear wall includes a notch engagable with the handle.

19. The applicator tool of claim 16, wherein the reservoir holds from 1 to about 4 liters.

20. The applicator tool of claim 15, wherein the handle is rotatably connected to the applicator.

21. An applicator tool adapted for applying a liquid onto a surface, the applicator tool comprising:

(a) a housing having a bottom surface, a front wall and a rear wall and a plurality of sidewalls, wherein the front wall and rear wall and sidewalls are connected to the bottom surface to define a reservoir adapted to receive liquid, and wherein the bottom surface has at least one opening for substantially continuously dispensing the liquid;

(b) a handle pivotably connected to the housing wherein the handle connection is offset from the center of the reservoir toward the rear of the reservoir such that upon lifting the liquid-filled reservoir, the handle interacts with the rear wall to prevent the reservoir from tipping and spilling the liquid.

* * * * *